US006359539B1

(12) United States Patent
Koga et al.

(10) Patent No.: US 6,359,539 B1
(45) Date of Patent: Mar. 19, 2002

(54) MAGNETIC CORE AND DEFLECTION YOKE HAVING THE SAME

(75) Inventors: Takasuke Koga, Moriya-Machi; Yusuke Okawa, Iwai; Yoji Motomiya, Moriya-Machi; Yutaka Miura, Honjo, all of (JP)

(73) Assignee: Victor Company of Japan, Ltd., Yokohama (JP)

( * ) Notice: Subject to any disclaimer, the term of this patent is extended or adjusted under 35 U.S.C. 154(b) by 0 days.

(21) Appl. No.: 09/258,064

(22) Filed: Feb. 26, 1999

(30) Foreign Application Priority Data

Feb. 26, 1998 (JP) ..... 10-062178

(51) Int. Cl.[7] ..... H01F 1/00; H01F 21/06; H01F 7/06

(52) U.S. Cl. ..... 335/212; 336/136; 29/607

(58) Field of Search ..... 336/136; 72/370.16–370.18, 72/31.01; 285/40; 407/24; 409/65–78; 470/8–12, 58–84; 29/607

(56) References Cited

U.S. PATENT DOCUMENTS 1,068,126 A * 7/1913 Hamilton et al. ..... 470/66
3,772,720 A * 11/1973 Yamamoto ..... 470/10
3,898,706 A * 8/1975 Rivalland et al. ..... 470/9
4,636,693 A * 1/1987 Saruta ..... 315/368
5,256,999 A * 10/1993 Utsugi et al. ..... 336/136
5,347,255 A * 9/1994 Saitoh et al. ..... 336/83
5,360,639 A * 11/1994 Kawabata ..... 427/270
5,375,955 A * 12/1994 Leslie ..... 411/378
5,432,401 A 7/1995 Satoh et al. ..... 313/440
5,724,873 A * 3/1998 Hillinger ..... 81/451

FOREIGN PATENT DOCUMENTS

| | | |
|---|---|---|
| EP | 0 187 964 | 7/1986 |
| JP | 05 021017 A | 1/1993 |
| JP | 07 162880 A | 6/1995 |

* cited by examiner

*Primary Examiner*—Ramon M. Barrera
(74) *Attorney, Agent, or Firm*—Anderson, Kill & Olick, P.C.

(57) ABSTRACT

A deflection yoke includes a bobbin having a cavity formed in the longitudinal direction of the bobbin, and an adjusting coil having a magnetic core on which a thread is cut. The core inserted into the cavity is slidable in the longitudinal direction of the bobbin. The core has a marker formed on only one of ends of the core in the longitudinal direction. The core has been inserted into the cavity from the one end formed with the marker or the other end. The marker is formed on only one of ends of the core before or after the thread is cut thereon.

18 Claims, 13 Drawing Sheets

MAGNETIC CORE AND DEFLECTION YOKE HAVING THE SAME

BACKGROUND OF THE INVENTION

The present invention relates to magnetic cores and deflection yokes having adjusting coils, such as, convergence coils wound around the cores.

Deflection yokes are assemblies of electromagnets placed around the neck of an electron-beam tube to produce a magnetic field for deflection of electron beams. Deflection yokes are provided with horizontal and vertical deflection coils for deflection of electron beams, and convergence coils for adjusting convergence of electron beams.

Convergence coils are made up of bobbins wound around which are coils that are connected to horizontal or vertical deflection coils. The bobbin has a magnetic core screwed thereinto. The core is rotated to vary the inductance of the coils wound around the bobbin to adjust the current flowing through the horizontal or vertical coils. The magnetic field generated by the horizontal or vertical coils are varied to adjust convergence of electron beams or cancel misconvergence on screen of braun tubes.

The core screwed into the bobbin is made of a baked magnetic body formed with a thread. The thread is cut on the baked body by a thread cutter. The cutter is provided with a roller and a thread cutting whetstone arranged as parallel to each other. The baked body is sent between the roller and the whetstone while the roller and whetstone are rotating to cut a thread on the baked body.

The inventors have found that the diameter of one end of the baked body, the core, is different from that of the other end when the thread cutting is completed. For example, a core of about 15 mm-long formed with a thread has one end from which the core is sent to the thread cutter and the other end, the diameter of the former end being larger than that of the latter by about 0.01 to 0.03 mm.

Screwing the cores having different diameters at both ends into bobbins causes differences in rotational torque. In fact, screwing cores from one end having a smaller diameter produces larger rotational torque than that produced when the cores are inserted into bobbins from the other end having larger diameters.

The difference in rotational torque lowers convergence adjustment efficiency. Because the rotational torque is varied for respective cores; cores would be broken when the rotational torque is too large; and cores would not be fixed in bobbins or would be moved by any accidental external shock given even after they are fixed when the rotational torque is too small. Furthermore, an effective rotational torque is not produced only by adjusting the height of protrusions that are generally formed inside the bobbins for torque adjustment. The number of times to screw the cores forwards and backwards in the bobbins thus must be changed for each core.

SUMMARY OF THE INVENTION

A purpose of the present invention is to provide a deflection yoke having an adjusting coil for which a variation of the rotational torque can be restricted when a magnetic core is inserted into a bobbin of the adjusting coil.

Another purpose of the present invention is to provide a method of producing a magnetic core that can be inserted into a bobbin from always the same end of the core.

The present invention provides a deflection yoke that includes a bobbin and an adjusting coil. The bobbin has a cavity formed in the longitudinal direction of the bobbin. The adjusting coil has a magnetic core on which a thread is cut, the core being inserted into the cavity and being slidable in the longitudinal direction of the bobbin, the core having a marker formed on only one of ends of the core in the longitudinal direction, the core having been inserted into the cavity from the one end formed with the marker or the other end.

Furthermore, the present invention provides a method of producing a core. A marker is formed on only one of ends of the core in the longitudinal direction thereof. And, a thread is cut on the core from the one end formed with the marker or from the other end.

Furthermore, the present invention provides a method of producing a core. A thread is cut on the core. And, a marker is formed on only one of ends of the core in the longitudinal direction thereof.

DETAILED DESCRIPTION OF PREFERRED EMBODIMENT

Preferred embodiments according to the present invention will be disclosed with reference to the attached drawings.

Figure 1:
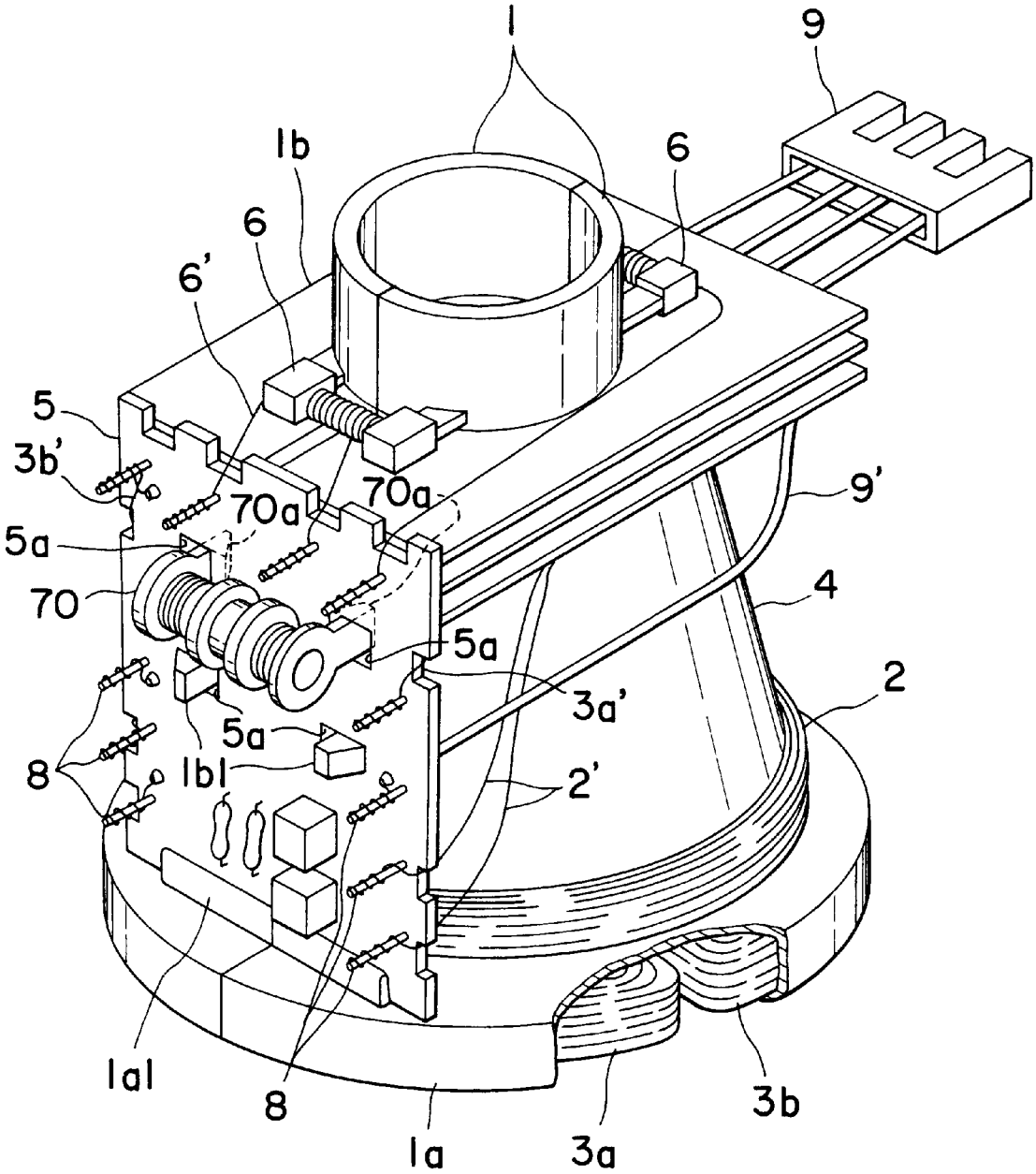
FIG. 1 is a partially cutaway view in perspective of a preferred embodiment of the deflection yoke according to the present invention.

Shown in FIG. 1 is an overall structure of a deflection yoke according to the present invention.

The deflection yoke shown in FIG. 1 is provided with a pair of funnel-like separators 1. Electrically separated by the separators 1 are a pair of vertical deflection coils 2 and a pair of horizontal deflection coils 3*a* and 3*b*. The vertical deflection coils 2 are wound around the outer wall of the separators 1, whereas the horizontal deflection coils 3*a* and 3*b* are wound like a saddle around the inner wall of the separators 1. Provided outside the vertical deflection coils 2 is a magnetic core 4, such as, a ferrite core.

The deflection yoke is further provided with a circuit board 5 mounted on which are electric circuits and components for the deflection characteristics adjustment. The circuit board 5 is attached to the one side of the separators 1 with a large flange 1*a* and a small flange 1*b*.

The circuit board 5 is further formed with rectangular openings 5*a*. The circuit board 5 is attached to the side of the separators 1 at one end by means of an engage section 1*a*1 formed at the flange 1*a*, and also hooks 5*a* integrally formed at the flange 1*b* and engaged with the rectangular openings 5*a*.

Mounted on the circuit board 5 is a convergence coil 70 (called a differential coil hereinafter) for correction of misconvergence which will be discussed later. The differential coil 70 is formed with hooks 70*a* at both ends in the longitudinal directions. The hooks 70*a* are engaged with the rectangular openings 5*a* to mount the differential coil 70 on the circuit board 5. Fixed on the flange 1*b* is a four-pole correction coil 6 for correction of coma (so called VCR).

The circuit board 5 is provided with terminal pins 8 wound around and soldered to which are wires 2' of the vertical deflection coils 2, wires 3*a*' and 3*b*' of the horizontal deflection coils 3*a* and 3*b*, respectively, and a wiring 6' of the correction coil 6. Also wound around and soldered to the terminal pins 8 are wires 9' of a connector 9 that is used for connecting the deflection yoke to the present invention to a power supply (not shown).

Figure 2:
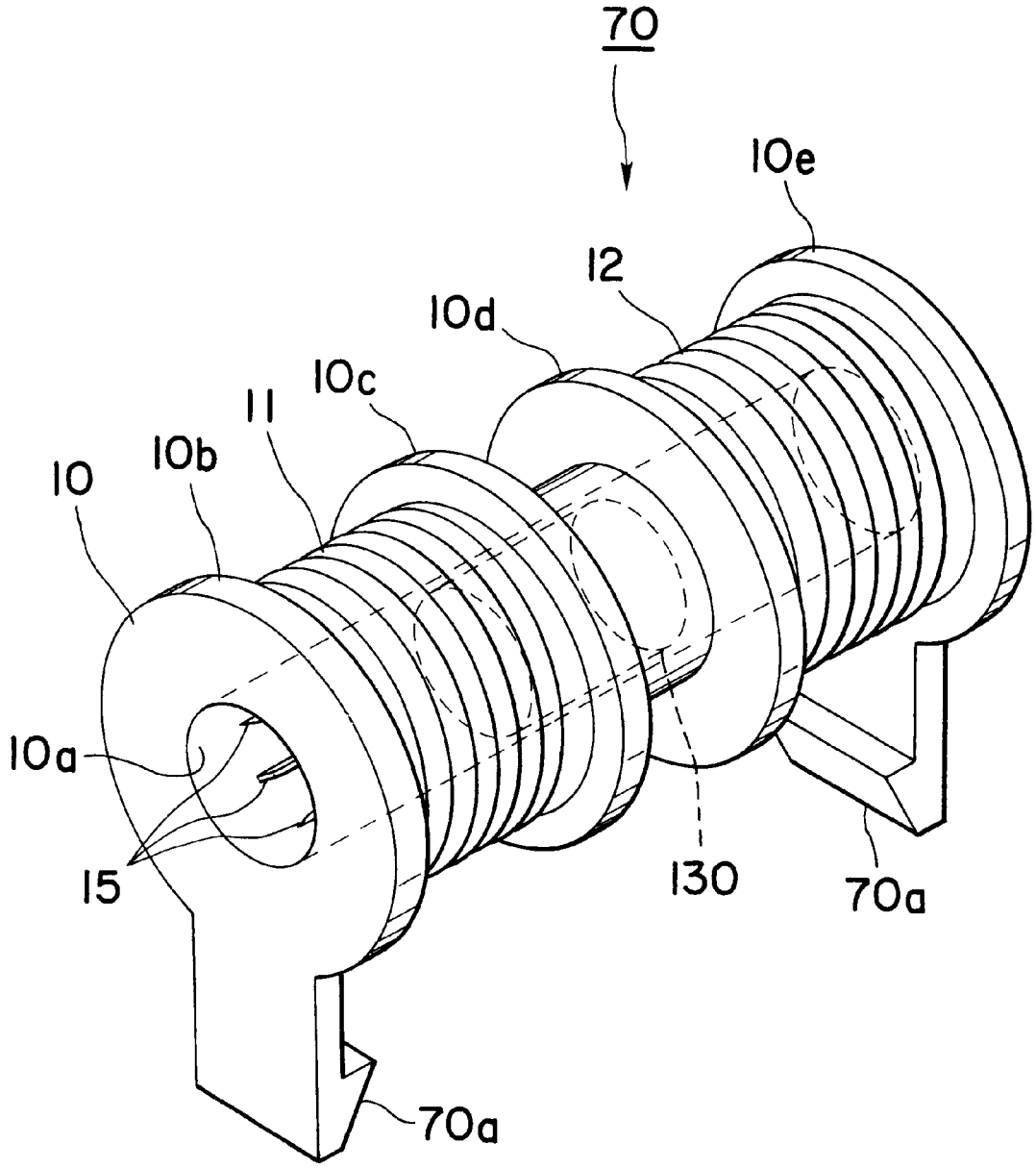
FIG. 2 is a perspective view of a convergence coil shown in FIG. 1.

Shown in FIG. 2 is the detailed structure of the differential coil 70 according to the present invention.

The differential coil 70 is provided with a bobbin 10 having a cylindrical cavity 10*a* formed in the longitudinal direction, and flanges 10*b*, 10*c*, 10*d* and 10*e*. The bobbin 10 is made of an insulator, such as, a plastic resin. The cylindrical cavity 10*a* is formed in the longitudinal direction to go through the bobbin 10.

Wound around the bobbin 10 are the first and the second coils 11 and 12 between the flanges 10*b* and 10*c*, and 10*d* and 10*e*, respectively. The first coil 11 is connected to the horizontal deflection coil 3*a*. The second coil 12 is connected to the horizontal deflection coil 3*b*.

Inserted into the cylindrical cavity 10*a* is a magnetic core 130 formed with a thread on the outer surface. The core 130 is called a screw core hereinafter. The cavity 10*a* is integrally formed with rib-like protrusions 15 in the inner surface of the bobbin 10. The screw core 130 is fixed into the cavity 10*a* by the protrusions 15.

Figure 3:
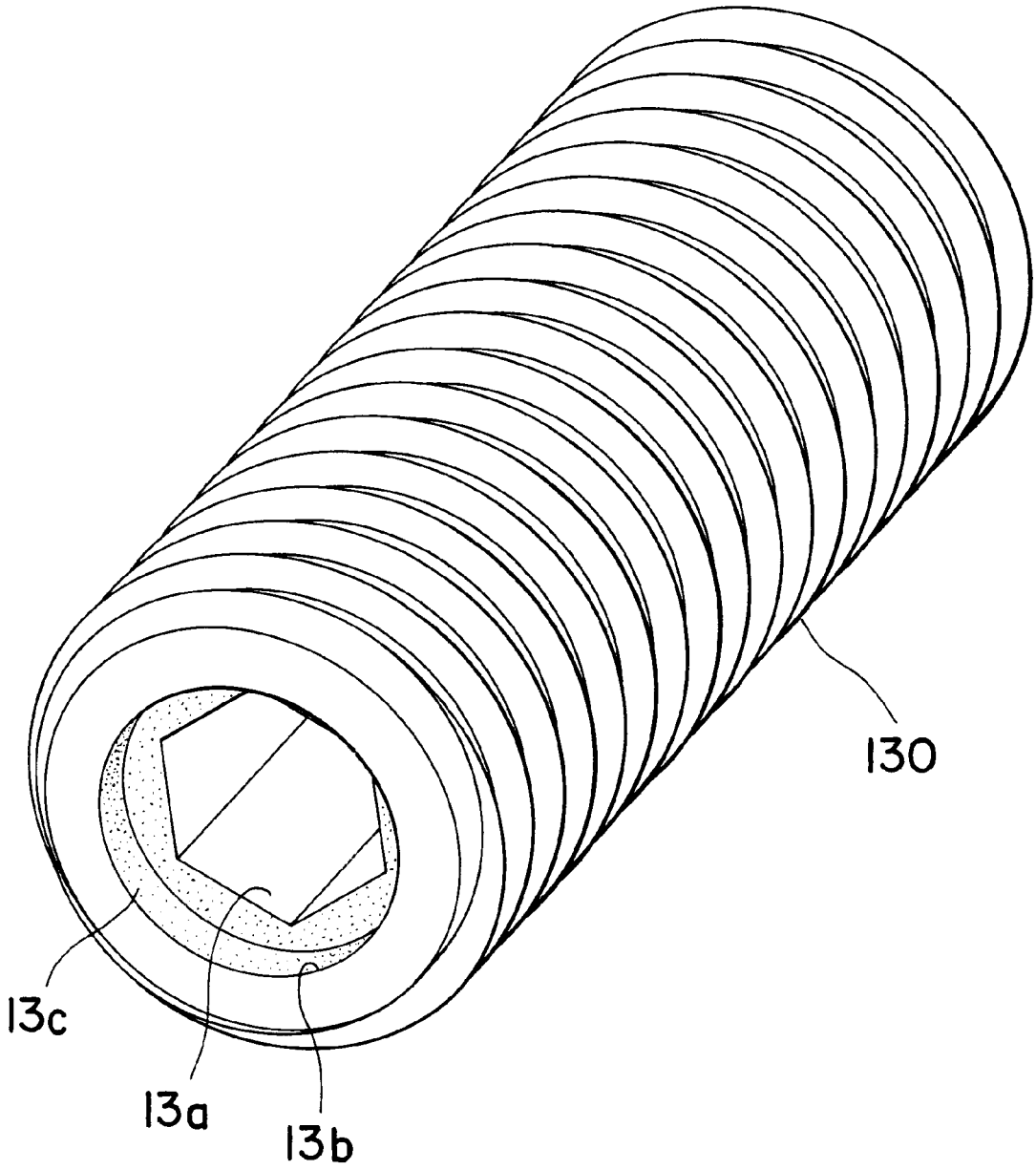
FIG. 3 is a perspective view of the first preferred embodiment of the magnetic core according to the present invention.

Shown in FIG. 3 is the first preferred embodiment of the screw core according to the present invention.

The screw core 130 has a hexagonal cavity 13*a* that is formed in the longitudinal direction to go through the core 130. The cavity 13*a* may not be hexagonal and also may not go through the core 130. Concavities 13*b* are formed at both ends of the screw core 130 in the longitudinal direction. Formed on one of the concavities 13*b* is a mark 13*c* that indicates the direction in which the screw core 130 is to be inserted into the bobbin 10. Such a mark is not formed on the other concavity 13*b*. With the mark 13*c*, it is determined whether the screw core 130 is inserted into the bobbin 10 of the differential coil 70 (FIG. 2) from the end on which the mark 13*c* is formed or the other end on which the mark is not formed.

Figure 4:
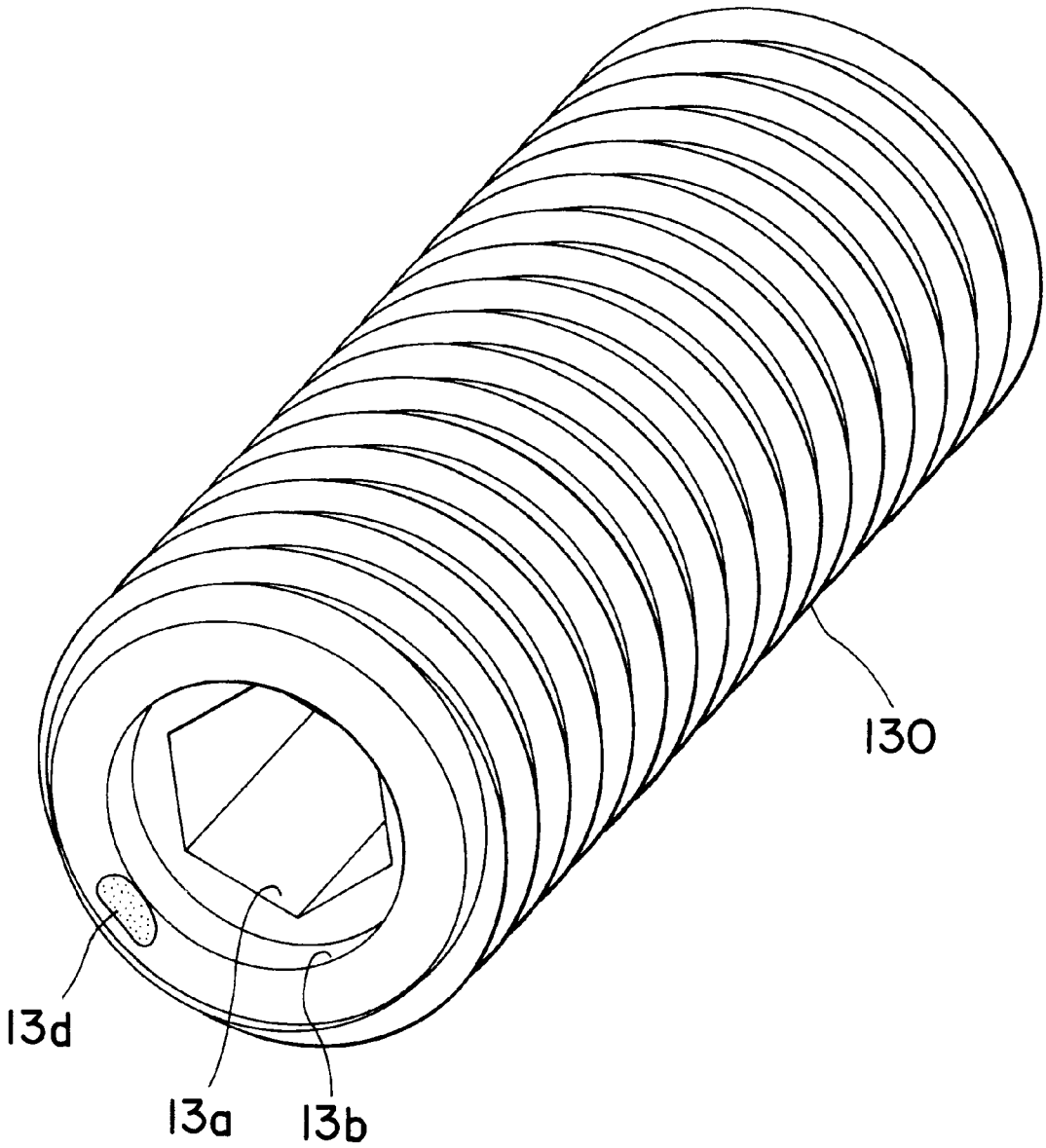
FIG. 4 is a perspective view of the second preferred embodiment of the magnetic core according to the present invention.

Shown in FIG. 4 is the second preferred embodiment of the screw core according to the present invention. In this embodiment, a dot-like mark 13*d* is formed at one end of the screw core 130, not at the concavity 13*b*.

Figure 5:
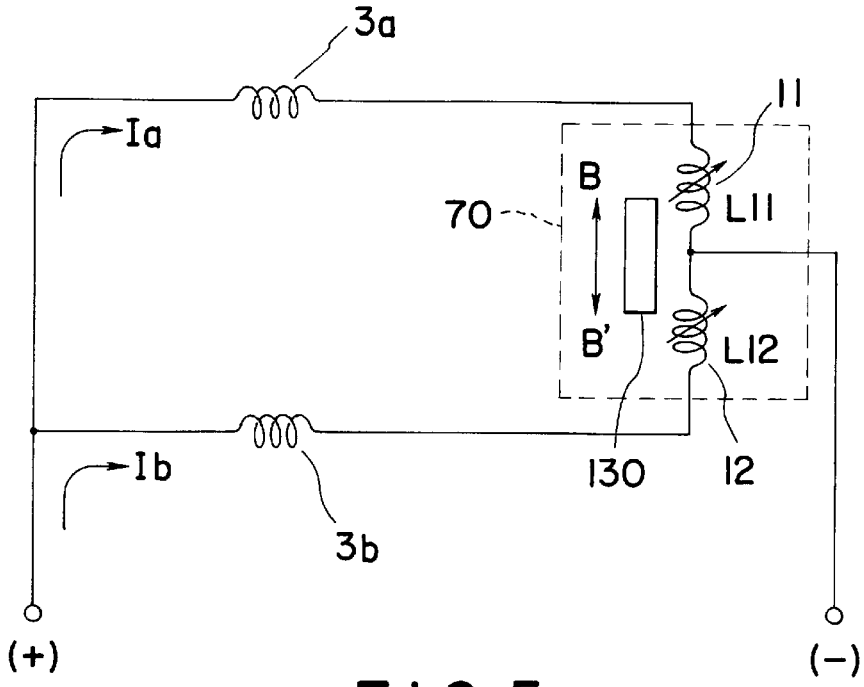
FIG. 5 is an equivalent circuit of a deflection yoke that connects the convergence coil and horizontal deflection coils.

The differential coil 70 having the core 130 formed with the mark 13*c* or 13*d* is attached to the deflection yoke as shown in FIG. 1, and then connected to the horizontal deflection coils 3*a* and 3*b* as shown in FIG. 5. In FIG. 5, the horizontal deflection coils 3*a* and 3*b* are connected in parallel across a power supply (not shown), and the coils 11 and 12 of the differential coil 70 are connected in series between the horizontal deflection coils 3*a* and 3*b*.

In operation, currents 1*a* and 1*b* flow through the deflection coils 3*a* and 3*b*, respectively, in FIG. 5. The screw core 130 is rotated to shift the position thereof in the cavity 10*a* in the longitudinal direction. The rotation of the core 130 causes differential variation of the inductance L11 and L12 of the coils 11 and 12, respectively, to vary the currents 1*a* and 1*b*.

Figure 6:
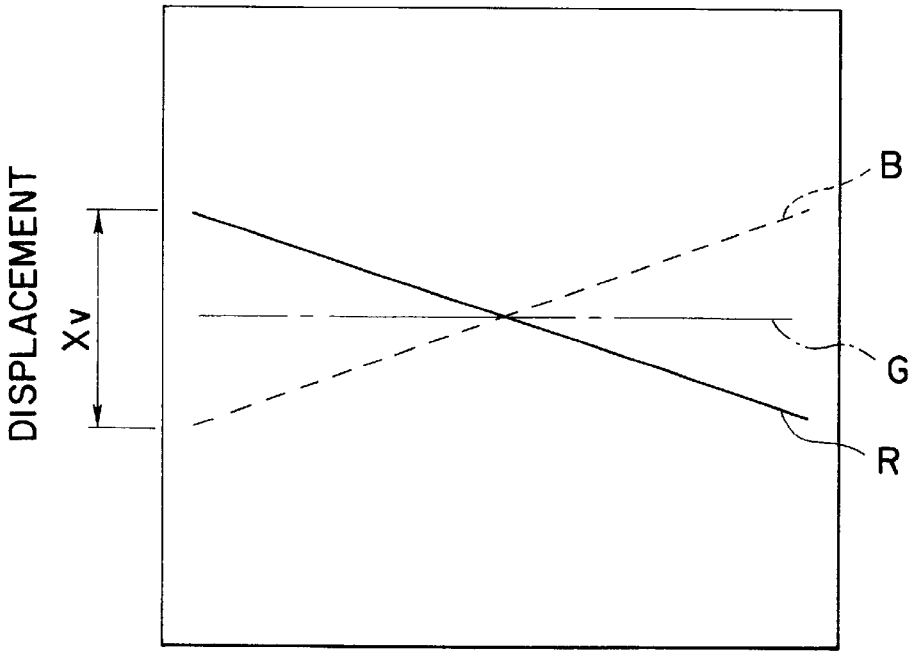
FIG. 6 illustrates a pattern of misconvergence on a screen.

Variation of the currents further causes variation of the magnetic fields generated by the horizontal deflection coils 3*a* and 3*b* to adjust the displacement Xv in the vertical direction on screen between electron beams for red (R) and blue (B) with respect to an electron beam for green (G) as shown in FIG. 6, which is one type of misconvergence.

Disclosed next are methods of producing the screw core 130 having the mark 13*c* or 13*d*.

Figure 7:
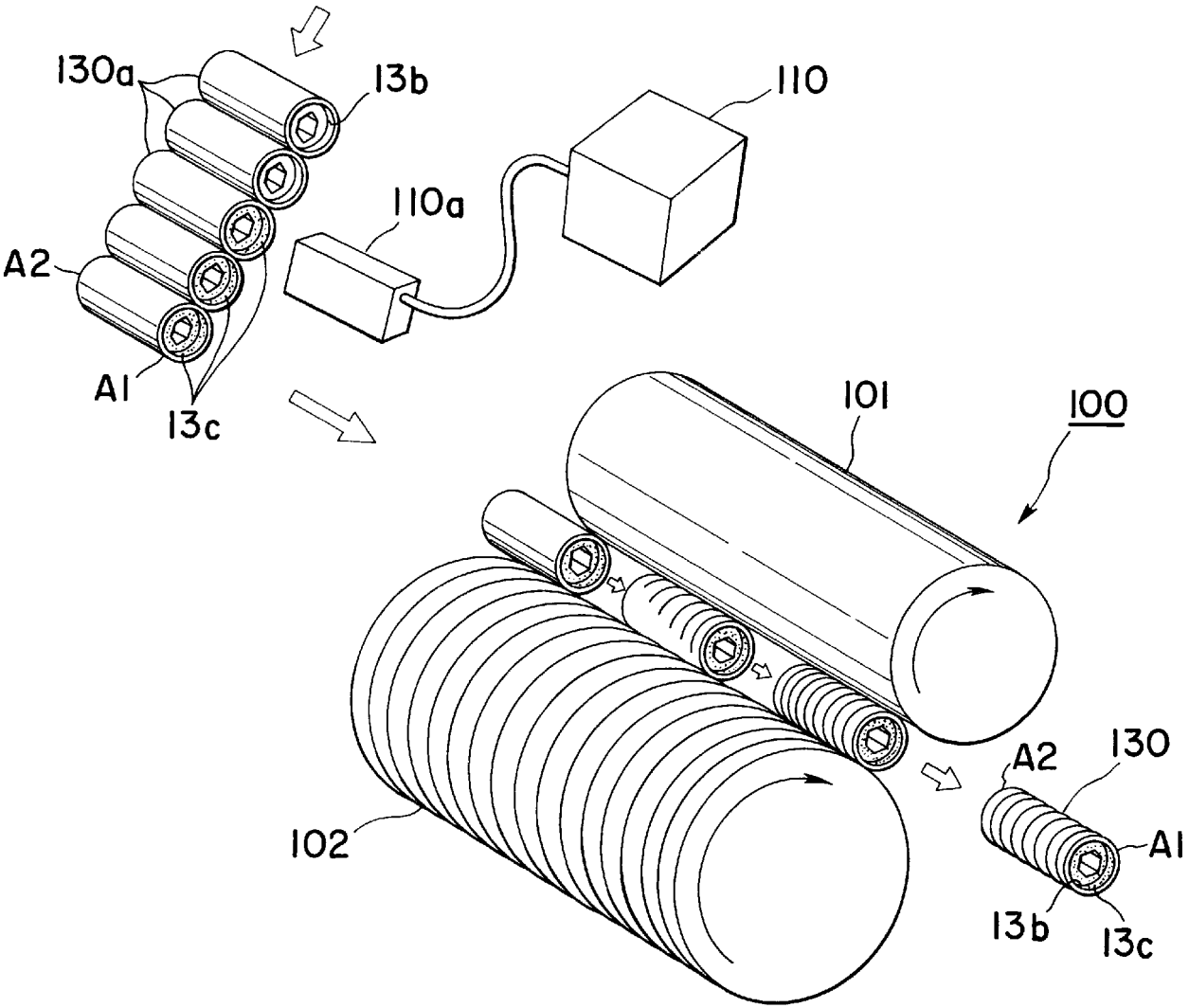
FIG. 7 is a perspective view illustrating the first preferred embodiment of the method of producing the magnetic core according to the present invention.

Illustrated in FIG. 7 is the first preferred embodiment of the method of producing a screw core according to the present invention. The method illustrated in FIG. 7 is the process of forming the mark 13*c* or 13*d* on baked bodies 130*a* before cutting a thread thereon. The marking process and the thread cutting process may be proceeded independently.

Firstly, ferrite is cast into cores and baked to be the baked bodies 130*a* as shown in FIG. 7. The baked bodies 130*a* are aligned and transferred to a thread cutter 100. Provided near the aligned baked bodies 130*a* and in front of the cutter 100 is an ink applying apparatus 110 having a printing head 110*a* that applies ink on each baked body 130*a* at one end in the longitudinal direction. The ink applying apparatus 110 may be an ink jet printer "Model 4800" provided by Linx Co.

Ink used for forming the mark 13*c* or 13*d* is preferably a quick-dry type. Furthermore, since the screw core 130 is black, the ink is preferably of blight color, such as, yellow or white for operators to easily find the mark. The product "Yellow Pigmented Ink 1039" provided by Linx Co. is recommended as the ink for forming the mark 13*c* or 13*d*. The color of the ink may be of fluorescent for an automatic identification apparatus to detect the mark.

The baked bodies 130*a* formed with the mark 13*c* or 13*d* are transferred to the thread cutter 100 one by one from one end A1 as shown in FIG. 7. The cutter 100 is provided with a roller 101 and a thread cutting whetstone 102 arranged as parallel to each other. The roller 101 presses each baked body 130*a* to the whetstone 102 while transferring the baked body 130*a* to the outside the thread cutter 100. Each baked body 130*a* is sent between the roller 101 and the whetstone 102 while the roller and whetstone are rotating in the direction as indicated by the arrows. A thread is cut on each baked body 130*a* while it is passing through the roller 101 and the whetstone 102, thus producing the screw core 130.

The screw core 130 produced as above would have an end A1 larger than another end A2 by about 0.01 to 0.03 mm.

However, with the aid of the mark 13*c* or 13*d* formed in the screw core 130, it is easily determined whether to insert the screw core 130 into the bobbin 10 from one end A1 or the other end A2. FIG. 7 shows that the mark 13*c* or 13*d* is formed at the end A1 from which the screw core 130 is inserted into the bobbin 10. The mark 13*c* or 13*d,* however, may be applied at the other end A2.

Figure 8:
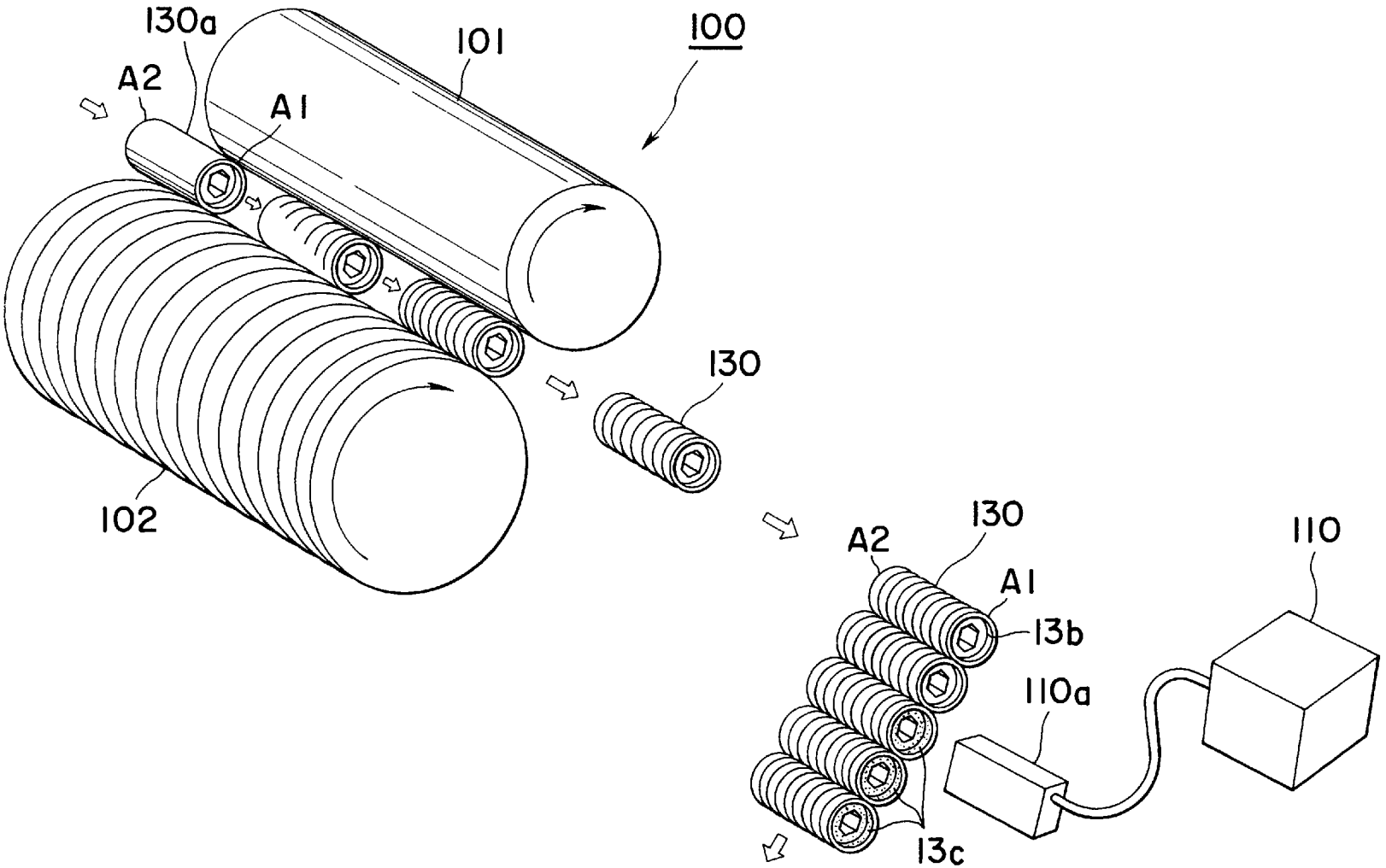
FIG. 8 is a perspective view illustrating the second preferred embodiment of the method of producing the magnetic core according to the present invention.

Illustrated in FIG. 8 is the second preferred embodiment of the method of producing a screw core according to the present invention. The process shown in FIG. 7 is to form the mark 13*c* or 13*d* on the baked bodies 130*a* before thread cutting. On the contrary, FIG. 8 shows the process of forming the mark 13*c* or 13*d* on the baked bodies 130*a* after thread cutting.

The baked bodies 130*a* are transferred to the thread cutter 100 one by one and formed with a thread thereon, thus producing the screw cores 130. The screw cores 130 are aligned in the direction vertical to the direction in which they have been transferred to the cutter 100, and then transferred to the ink injector 110. The ink applying apparatus 110 applies the ink from the ink head 110*a* on each screw core 130 at one end in the longitudinal direction to produce the screw core 130 as shown in FIG. 3 or 4 having the mark 13*c* or 13*d*.

The method illustrated in FIG. 7 (marking and then thread cutting) is preferable than that illustrated in FIG. 8 (thread cutting and then marking). Because a thread is cut on each baked body 130*a* while a cooling fluid is being pored on the baked body 130*a* and also the thread cutting whetstone 102 to cool them. A little cooling fluid has remained on the screw core 130 just after the thread cutting process is completed. Hence, ink should be applied on the screw core 130 after it is dried.

Figure 9:
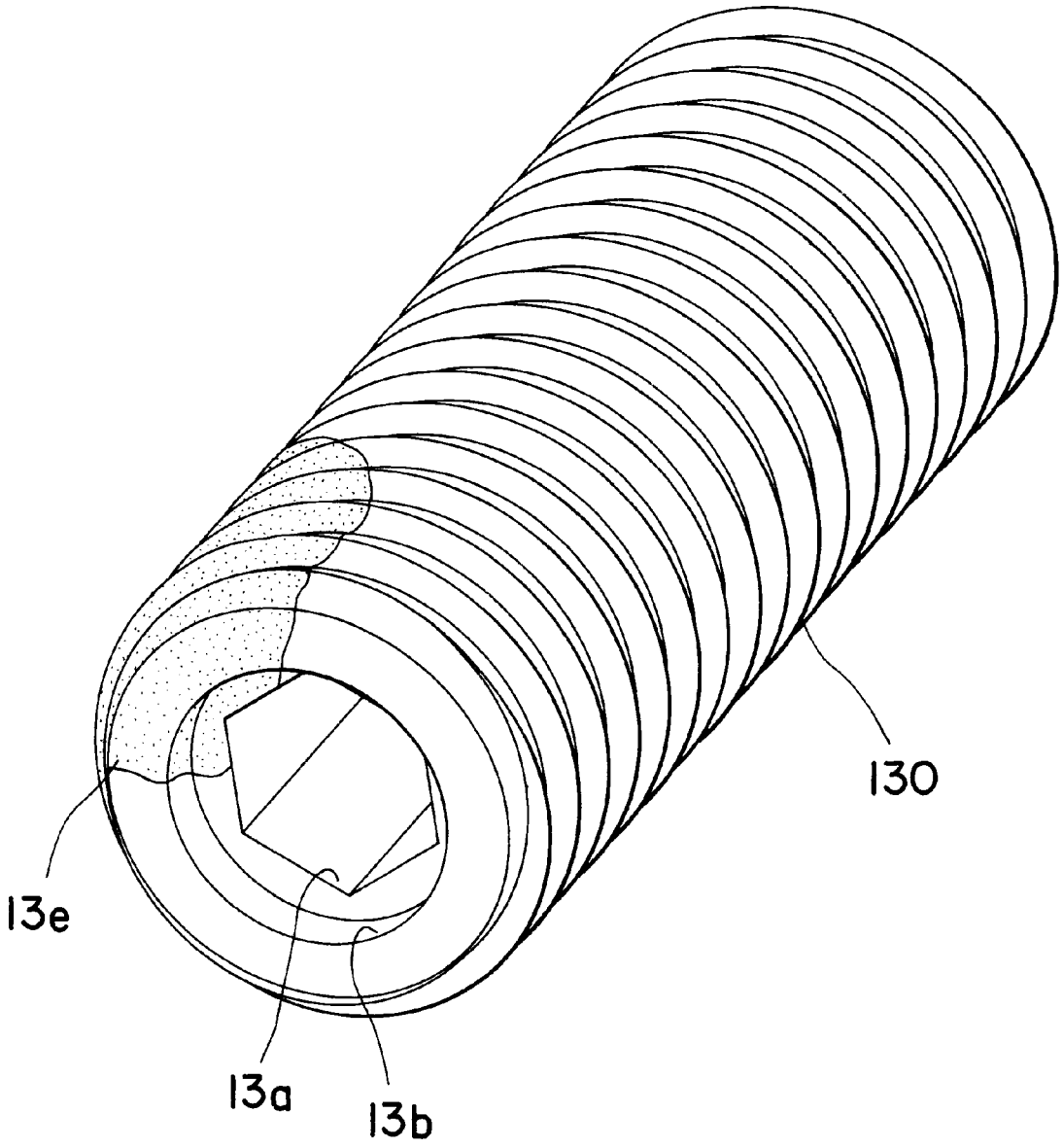
FIG. 9 is a perspective view of the third preferred embodiment of the magnetic core according to the present invention.

Shown in FIG. 9 is the third preferred embodiment of the screw core according to the present invention.

FIG. 9 shows that the screw core 130 has a mark 13*e* that extends from the inner surface to the outer surface of the screw core 130. This embodiment achieves easier identification of both ends of the core 130 on whether from one of the ends formed with the mark 13*e* or the other end it is to be inserted into the bobbin 10.

A large amount of ink is, however, needed for the embodiment of FIG. 9 compared to those shown in FIGS. 3 and 4. The amount of ink must be adjusted so as not to generate an excess rotational torque while the screw core 130 is being inserted into the bobbin 10. Furthermore, care must be taken that screw cores 130 must be separated from each other during the marking process so as not to be applied with an excess amount of ink.

The marks 13*c* and 13*d* shown in FIGS. 3 and 4, respectively, are preferable than the mark 13*e* shown in FIG. 9 because such care discussed above is not need to be taken. Particularly, the mark 13*c* shown in FIG. 3 can be formed even with ink that is not a quick-dry type because the ink is applied only in the concavity 13*b*. Application of ink only in the concavity rarely causes spread of ink to the outer surface of the screw core 130, further to other screw cores even though screw cores touch each other before ink is dried.

As disclosed above, the present invention achieves easy identification of both ends of a screw core on whether from one of the ends or the other end it is inserted into a bobbin of a defection yoke with the aid of a mark formed at one end of the screw core.

Furthermore, the present invention achieves restriction of a variation of the rotational torque generated while screw cores are being inserted into bobbins by insertion of the screw cores from always one end formed with the mark or always the other end without the mark.

Figure 10:
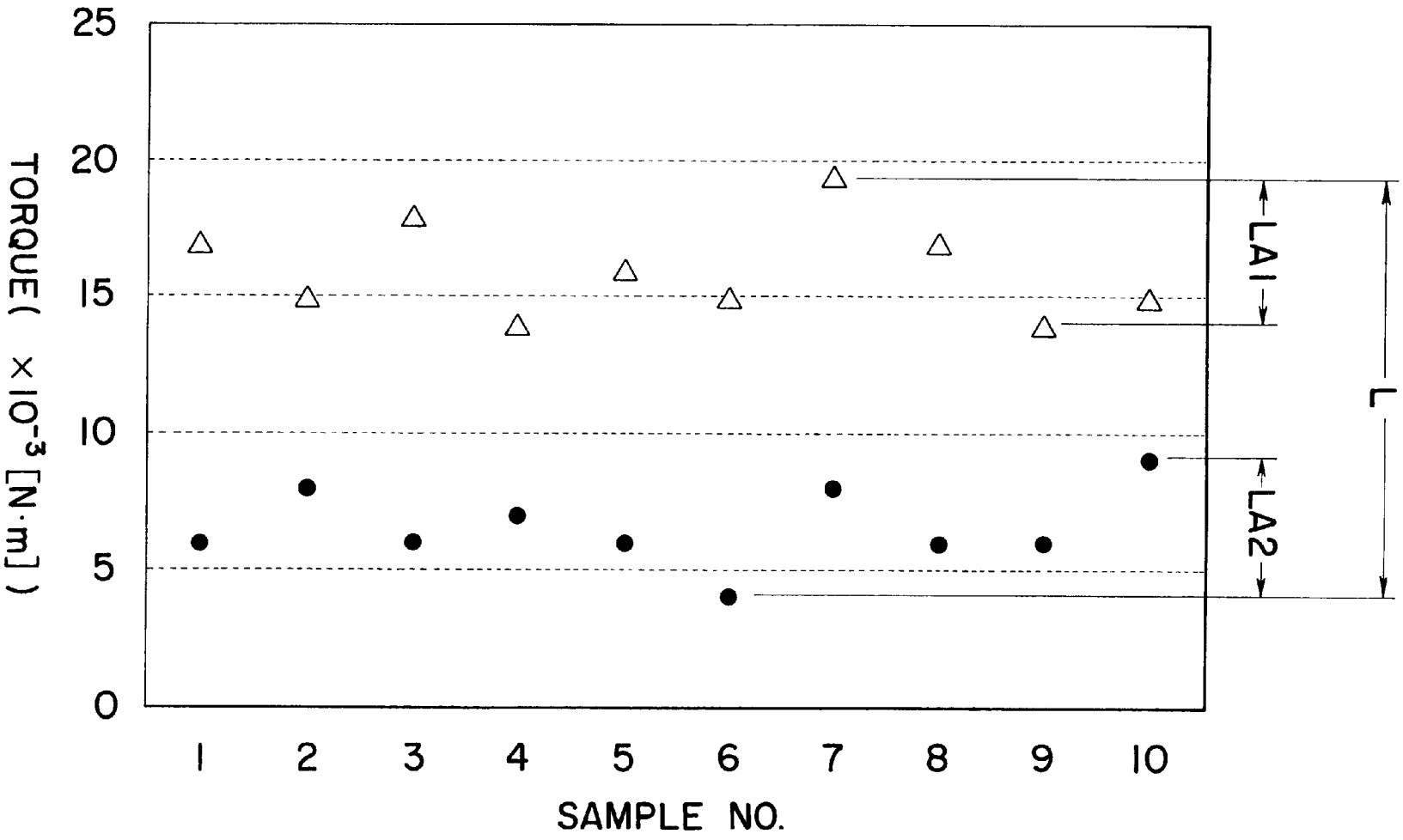
FIG. 10 is a graph showing problems occurred in conventional magnetic cores and advantages of the magnetic cores according to the present invention.

Shown in FIG. 10 is a graph that depicts variations of the rotational torque. The signs "Δ" indicate a variation of the rotational torque generated while screw cores (sample NO. 1 to 10) are being inserted into bobbins from an end having a small diameter. On the other hand, the signs "●" indicate a variation of the rotational torque generated while the screw cores (sample NO. 1 to 10) are being inserted into bobbins from the other end having a large diameter.

The graph shows the maximum difference L in rotational torque existed between the first case (graph "Δ") where screw cores are inserted into bobbins from an end having a small diameter and the second case (graph "●") where they are inserted from the other end having a large diameter. The difference L is generally caused by insertion of screw cores to bobbins due to the careless of difference in diameter of both ends of screw cores.

Contrary to this, the present invention achieves the maximum difference in rotational torque LA1 in the first case and LA2 in the second case, both being much smaller than L, by insertion of screw cores to bobbins from always the same end having or not having the mark, such as the marks 13*c,* 13*d* and 13*e* shown in FIGS. 3, 4 and 9.

Figure 11:
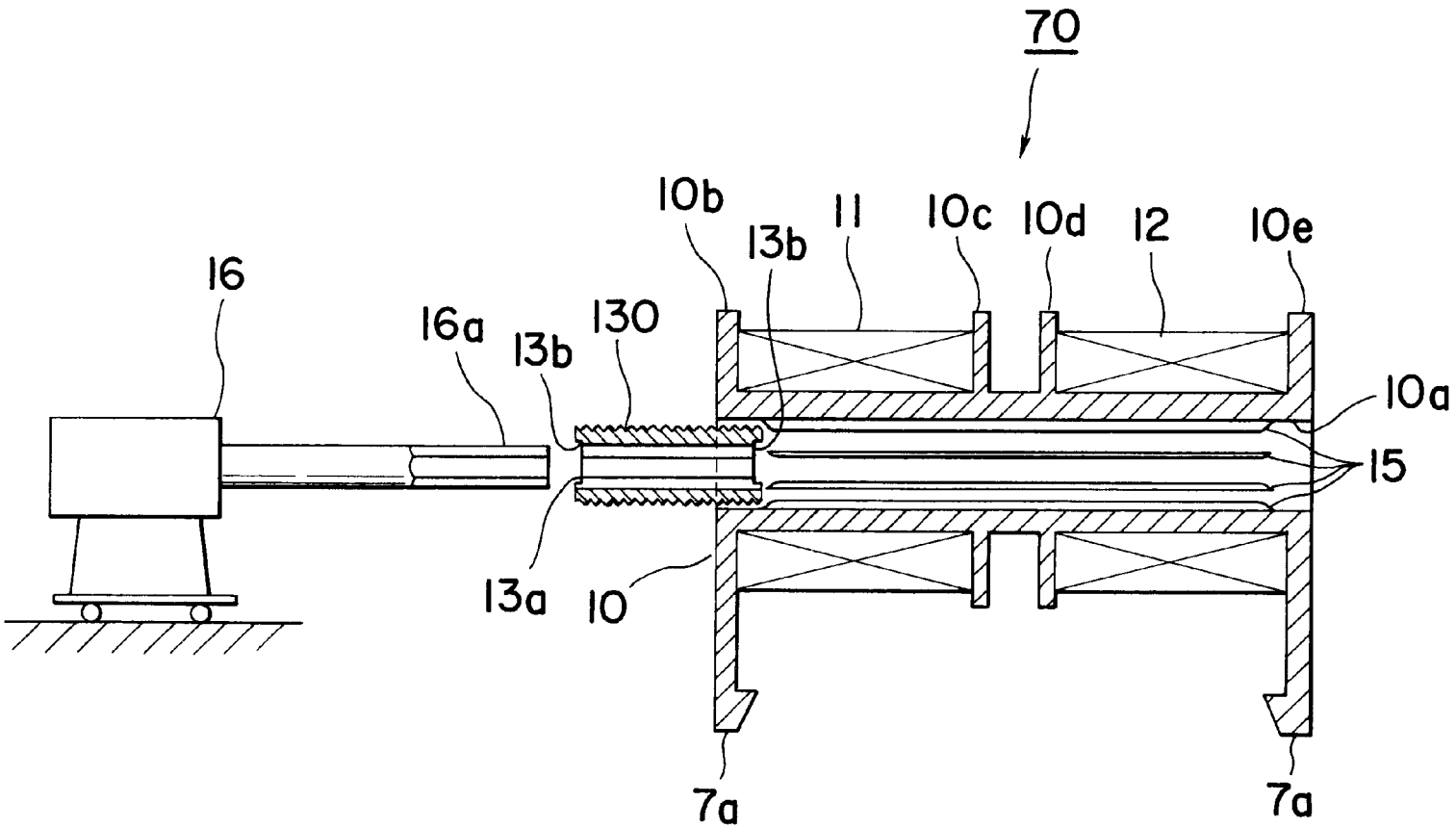
FIG. 11 illustrates insertion of the magnetic core into a bobbin of a convergence coil.
Figure 12:
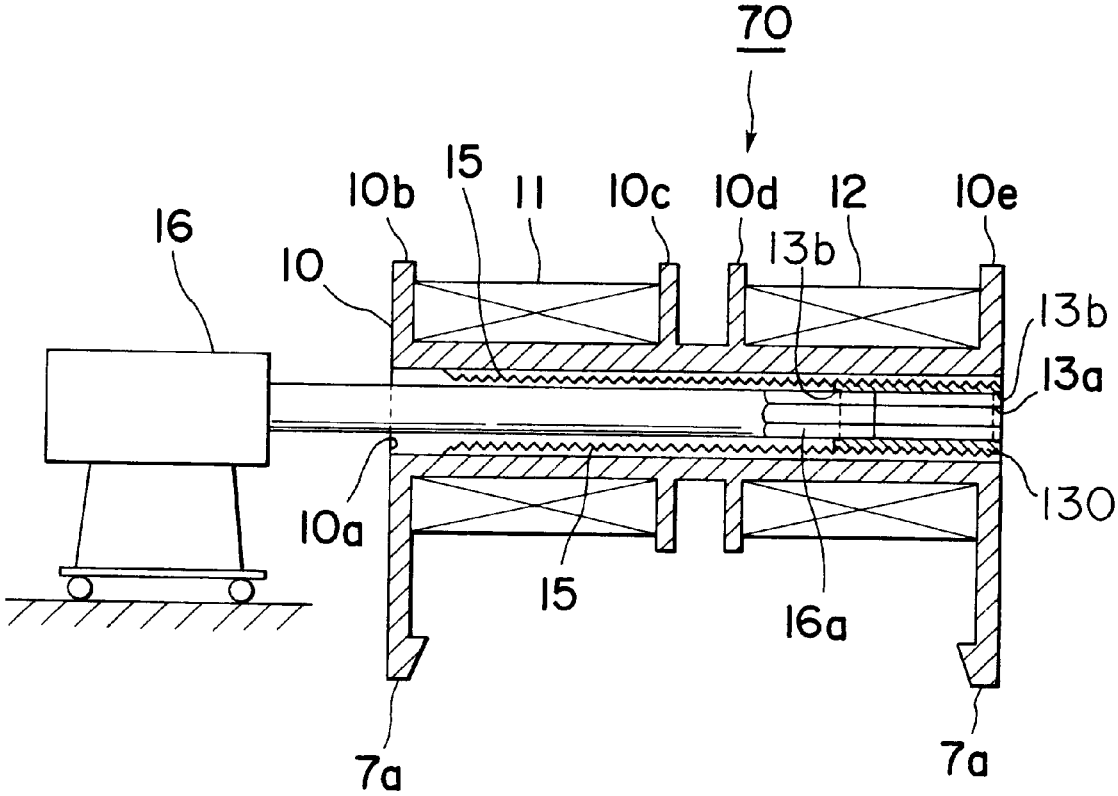
FIG. 12 also illustrates insertion of the magnetic core into the bobbin of the convergence coil.
Figure 13:
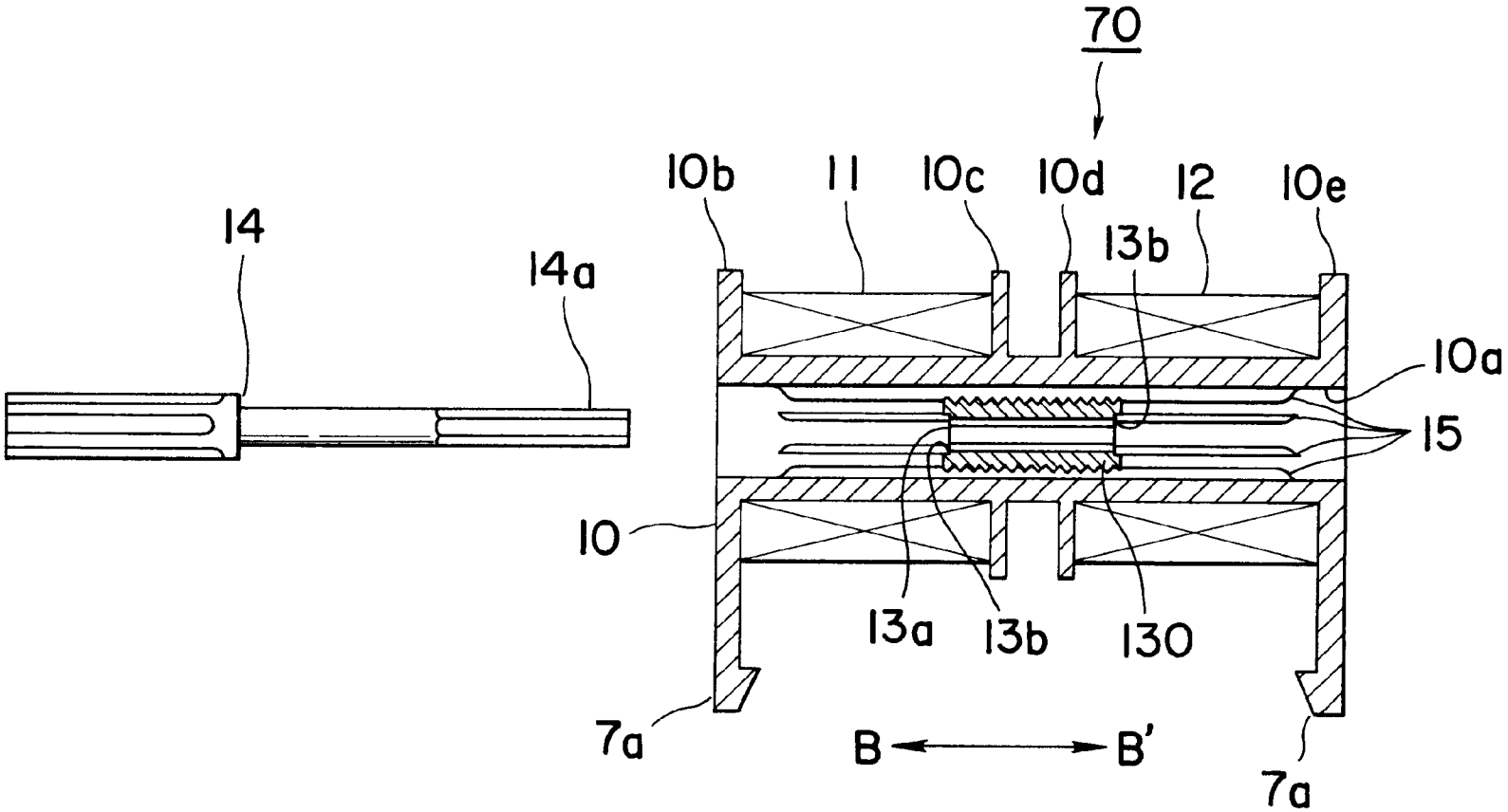
FIG. 13 further illustrates insertion of the magnetic core into the bobbin of the convergence coil.

Illustrated in the figures from FIGS. 11 to 13 is the process of inserting the screw core 130 into the bobbin 10.

The screw core 130 is inserted into the cavity 10*a* by an automatic insertion apparatus 16 as shown in FIG. 11 from one end having or not having the mark 13*c,* 13*d* or 13*e*. The apparatus 16 has a hexagonal tip 16*a* that is to be inserted into the hexagonal cavity 13*a* of the screw core 130. The screw core 130 is inserted and screwed into the cavity 10*a* from one end to reach the other end of the bobbin 10 as shown in FIG. 12 to form a thread on the inner surface of the bobbin 10 in the longitudinal direction of the protrusions 15.

The screw core 130 is then rotated backwards so that it is located in almost the middle of the bobbin 10 as shown in FIG. 13. The screw core 130 may be rotated forwards and backwards several times before being located in the middle. Operators can manually adjust the location of the screw core 130 by an adjuster 14 having a hexagonal tip 14*a* that is to be inserted into the hexagonal cavity 13*a* of the screw core 130.

Instead of the automatic insertion apparatus 16 shown in FIG. 12, operators can manually insert and screw the screw core 130 by using the adjuster 14 into the cavity 10*a* of the bobbin 10 from one end having or not having the mark 13*c,* 13*d* or 13*e*.

Figure 14:
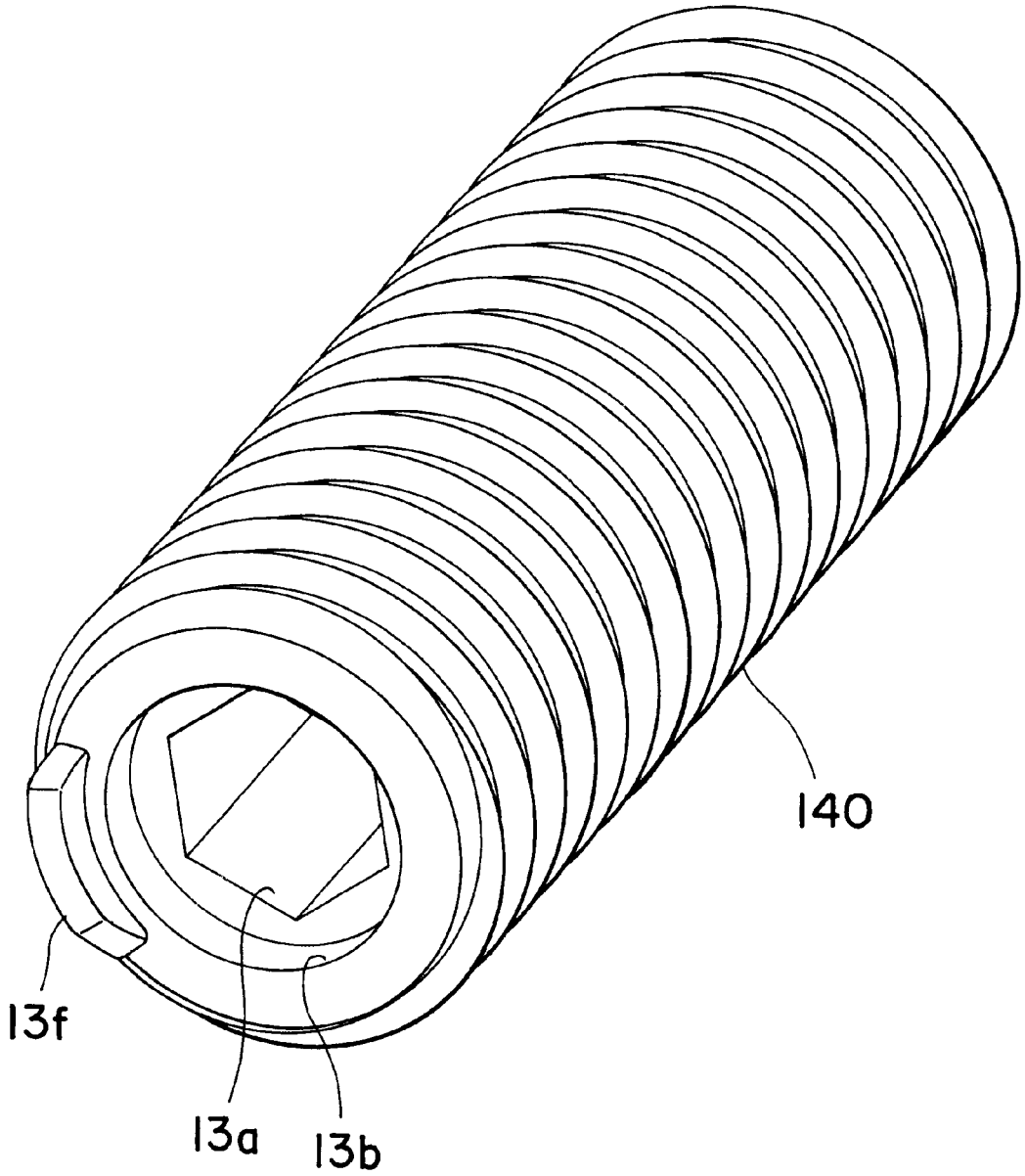
FIG. 14 is a perspective view of the fourth preferred embodiment of the magnetic core according to the present invention.

Illustrated in FIG. 14 is the fourth preferred embodiment of the screw core according to the present invention. A magnetic screw core 140 has a protrusion 13*f* that is integrally formed only on one end of the core 140. The protrusion 13*f* is preferably formed while a powder ferrite is being cast to be cores before baking. However, it may be formed after baking. Baked cores are transferred to the thread cutter 100 as shown in FIG. 7 or 8 from always one end having the protrusion 13*f* or always the other end not having such a protrusion.

Instead of the protrusion 13*f,* a concavity or another form may be integrally formed only on one end of the core 140 to indicate the difference in shape of both ends of the screw core. All the forming processes described above for the protrusion 13*f* can be applied to formation of such a concavity or another form. Furthermore, the mark 13*c,* 13*d* or 13*e* can also be formed on the one end of the screw core 140 where the protrusion 13*f,* a concavity or another is integrally formed.

The deflection yoke having the screw core according to the present invention as described above can be installed into a test brawn tube before shipment to adjust the deflection characteristics. The test brawn tube is the one designated by integrated tube component (ITC) manufacturers that provide sets of brawn tubes and deflection yokes.

When the deflection yokes having the screw cores according to the present invention are delivered to ITC manufacturers, operators will manually rotate and move each core screw, before delivery, in the directions depicted by the arrows B and B' as shown in FIG. 13 by using the adjuster 14. The movement of the core screw differentially varies the inductance L11 and L12 of the coils 11 and 12, respectively, as shown in FIG. 5 to adjust the displacement Xv, misconvergence, in the vertical direction on screen between electron beams for red (R) and blue (B) as shown in FIG. 6.

The ITC manufacturers will install the delivered deflection yokes into brawn tubes that will be products. The test brawn tube and the brawn tubes to be products have differences in electrical characteristics from each other. The ITC manufacturers will also rotate and move each core screw by using the adjuster 14 as shown in FIG. 13 to cancel the misconvergence. The readjusted deflection yokes will be then shipped to, for example, display manufacturers.

The embodiments described above are related to the deflection yoke and the core installed in the convergence coil of the deflection yoke, used for adjusting the displacement Xv, misconvergence, in the vertical direction on screen between electron beams for red and blue.

It is however understood by those skilled in the art that the foregoing descriptions are preferred embodiments of the invention and that various changes and modifications may be made in the invention without departing from the spirit and scope thereof.

For example, the core according to the invention can be applied to the inductance-variable coil described in Japanese Unexamined Patent Application No. 7(1995)-162880 published on Jun. 23, 1999. The inductance-variable coil is used to adjust the displacement Xh in the horizontal direction on screen between electron beams for red and blue.

Furthermore, the marks 13*c*, 13*d* and 13*e* described above and used for indicating the direction from which end the core should be inserted into the bobbin are formed by applying ink on the core by the ink applying apparatus 110. These marks however may be formed by painting or by a laser.

As disclosed above, the magnetic core according to the present invention is formed with a mark only on one of both ends of the core, and can be used as one component of a deflection yoke. The mark can be formed on the one end of the core before or after the thread cutting.

In manufacturing, magnetic cores are inserted into bobbins from always the one end formed with the mark or the other end without such a mark. Variation of the rotational torque generated when the magnetic cores are inserted into the bobbins are thus restricted markedly.

Therefore, the present invention achieves easy positional adjustment of the cores in the bobbins. Furthermore, the cores can be protected from any physical damage that would happen if the rotational torque were too large. Moreover, the cores can be fixed in the bobbins without movement that would be caused by any accidental external shock given even after they are fixed when the rotational torque were too small.

What is claimed is:

1. A method of producing a core to be inserted into a bobbin of a deflection yoke, comprising the steps of:

forming a marker on a core having the shape of an almost uniform cylinder from a first end to a second end in a longitudinal direction thereof, the marker being formed on only the first end of the core; and cutting a thread on the core while the entire body of the core is transferred between a pair of rollers, one of which is formed with a whetstone in a predetermined direction from the first end formed with the marker or from the second end, wherein the core on which the thread has been cut through the cutting step has a slight difference in diameter between the first end and the second end and the marker formed on only the first end of the core indicates whether the diameter at the first end is slightly larger or smaller than the diameter at the second end.

2. The method according to claim 1 wherein the marker forming step includes the step of applying ink on only the first end of the core.

3. The method according to claim 1 wherein the marker forming step includes the step of forming a protrusion or concavity on only the first end of the core.

4. A method of producing a magnetic core to be inserted into a bobbin of a deflection yoke, comprising the steps of:

cutting a thread on a core having the shape of an almost uniform cylinder from a first end to a second end in a longitudinal direction thereof while the entire body of the core is being transferred between a pair of rollers, one of which is formed with a whetstone, from the first end or the second end of the core in the longitudinal direction; and forming a marker, after the thread is cut, only on the first end of the core, wherein the core on which the thread has been cut through the cutting step has a slight difference in diameter between the first end and the second end and the marker formed on only the first end of the core indicates whether the diameter at the first end is larger or smaller than the diameter at the second end.

5. The method according to claim 4 wherein the marker forming step includes the step of applying ink on only the first end of the core.

6. The method according to claim 4 wherein the marker forming step includes the step of forming a protrusion or concavity on only the first end of the core.

7. A method of producing a plurality of cores to be inserted into a deflection yoke, comprising the steps of:

forming a marker on each of the cores, each of cores having the shape of an almost uniform cylinder from a first end to a second end in a longitudinal direction thereof, the marker being formed on only the first end of each of the cores; and cutting a thread on each of the cores while the entire body of each of the cores is transferred between a pair of rollers, one of which is formed with a whetstone, in a predetermined direction from either the first end formed with the marker or from the second end, the predetermined direction being the same for all the cores, wherein each of the cores on which the thread has been cut through the cutting step has a slight difference in diameter between the first end and the second end with the marker formed on only the first end of each of the cores indicates whether the diameter at the first end is slightly larger or smaller than the diameter at the second end.

8. The method according to claim 7, wherein the marker forming step includes the step of applying ink on only the first end of each of the cores.

9. The method according to claim 7, wherein the marker forming step includes the step of forming a protrusion or a concavity on only the first end of each of the cores.

10. A method of producing a plurality of magnetic cores to be inserted into a deflection yoke, comprising the steps of:

cutting a thread on each of the cores, each of the cores having the shape of an almost uniform cylinder from a first end to a second end in a longitudinal direction thereof, while the entire body of each of the cores are successively transferred between a pair of rollers, one of which is formed with a whetstone, from the first or the second end of each of the cores in the longitudinal direction thereof; and forming a marker, after the thread is cut, on each of the cores on only the first end for all the cores, wherein each of the cores on which the thread has been cut through the cutting step has a slight difference in diameter between the first end and the second end with the marker formed on only the first end of each of the cores indicating whether the diameter at the first end is slightly larger or smaller than the diameter at the second end.

11. The method according to claim 10, wherein the marker forming step includes the step of applying ink on only the first end of each of the cores.

12. The method according to claim 10, wherein the marker forming step includes the step of forming a protrusion or a concavity on only the first end of each of the cores.

13. A method of producing a plurality of deflection yokes comprising the steps of:

forming a marker on each of a plurality of magnetic cores, each of said cores having the shape of an almost uniform cylinder from a first end to a second end in a longitudinal direction thereof, the marker being formed on only the first end of each of the cores;

cutting a thread on each of the cores while each of the cores in their entirety is transferred between a pair of rollers, one of which is formed with a whetstone, in a predetermined direction starting from either the first end formed with the marker or from the second end, the predetermined direction being the same for all the cores; and inserting the cores, after the thread is cut on each of the cores, into bobbins of the deflection yokes always from the first end formed with the marker that indicates whether the diameter at the first end is larger or smaller than the diameter at the second end due to the thread-cutting or from the second end.

14. The method according to claim 13, wherein the marker forming step includes the step of applying ink on only the first end of each of the cores.

15. The method according to claim 13, wherein the marker forming step includes the step of forming a protrusion or a concavity on only the first end of each of the cores.

16. A method of producing a plurality of deflection yokes comprising the steps of:

cutting a thread on each of a plurality of magnetic cores, each of the cores having the shape of an almost uniform cylinder from a first end thereof to a second end in a longitudinal direction thereof, while the entire cores are successively transferred between a pair of rollers, one of which is formed with a whetstone, from the first or the second end of each of the cores in the longitudinal direction;

forming a marker, after the thread is cut, on each of the cores on only the first end for all the cores; and inserting the cores into bobbins of the deflection yokes always from the first end formed with the marker that indicates whether the diameter at the first end is larger or smaller than the diameter at the second end due to the thread-cutting or from the second end.

17. The method according to claim 16, wherein the marker forming step includes the step of applying ink on only the first end of each of the cores.

18. The method according to claim 16, wherein the marker forming step includes the step of forming a protrusion or a concavity on only the first end of each of the cores.

* * * * *

UNITED STATES PATENT AND TRADEMARK OFFICE

CERTIFICATE OF CORRECTION

PATENT NO. : 6,359,539 B1 
DATED : March 19, 2002
INVENTOR(S) : Takasuke Koga et al.

It is certified that error appears in the above-identified patent and that said Letters Patent is hereby corrected as shown below:

Title page,
Item [73], Assignee: Victor Company of Japan, Ltd., Yokohama (JP)" should read -- Assignees: Victor Company of Japan, Ltd., Yokohama (JP) and TDK Corporation, Tokyo (JP) --

Signed and Sealed this

Twenty-first Day of October, 2003

JAMES E. ROGAN
*Director of the United States Patent and Trademark Office*